US008268125B2

(12) United States Patent
Retsina et al.

(10) Patent No.: US 8,268,125 B2
(45) **Date of Patent: *Sep. 18, 2012**

(54) METHOD FOR VAPOR PHASE PULPING WITH ALCOHOL AND SULFUR DIOXIDE

(75) Inventors: Theodora Retsina, Atlanta, GA (US); Vesa Pylkkanen, Atlanta, GA (US); Adriaan Reinhard P. van Heiningen, Orono, ME (US)

(73) Assignee: API Intellectual Property Holdings, LLC, Atlanta, GA (US)

( * ) Notice: Subject to any disclaimer, the term of this patent is extended or adjusted under 35 U.S.C. 154(b) by 277 days.

This patent is subject to a terminal disclaimer.

(21) Appl. No.: 12/409,357

(22) Filed: Mar. 23, 2009

(65) Prior Publication Data

US 2009/0236060 A1 Sep. 24, 2009

Related U.S. Application Data

(60) Provisional application No. 61/064,744, filed on Mar. 24, 2008.

(51) Int. Cl.
*D21C 3/06* (2006.01)
*D21C 3/20* (2006.01)

(52) U.S. Cl. ..... 162/83; 162/72; 162/77; 162/82

(58) Field of Classification Search ..... 162/72, 162/77, 82, 83

See application file for complete search history.

(56) References Cited

U.S. PATENT DOCUMENTS

| | | | | |
|---|---|---|---|---|
| 3,523,060 | A | 8/1970 | Herdle et al. | |
| 4,397,712 | A * | 8/1983 | Gordy | 162/19 |
| 5,338,405 | A * | 8/1994 | Patt et al. | 162/25 |
| 5,522,958 | A * | 6/1996 | Li | 162/19 |
| 6,165,317 | A * | 12/2000 | Sabourin | 162/23 |
| 6,524,436 | B2 * | 2/2003 | Kettunen et al. | 162/47 |

OTHER PUBLICATIONS

Restina et al., AVAP, A novel Biorefinery Concept, Feb. 2007, tappi Web exclusives, whole document.*

Heald editor, Cameron Hydrualic Data, 2002, 19th edition, p. 5-19 through 5-20.*

Methanex publisher, Technical Information and Safe Handling Guide for Methanol, Sep. 2006, Methanex, whole document.*

Chandrasekaran, Vapor Phase Pulping with Ammonia and Sulfure Dioxide Gases, Jun. 1972, SUNY ESF, whole document.*

Pulp and Paper Manufacture, Sulfite Science & Technology, Third Edition, vol. 4, Ingruber, Otto V., Kocurek, Michael J., Wong, Al, 1985.

Vapour phase sulphur dioxide pulping of Eucalyptus regnans, Appita, vol. 28, No. 3, H. Mamers and N.C. Grave, Nov. 1974.

Rapid Sulfite Pulping in Concentrated Sulfur Dioxide Solutions, Tappi, vol. 52, No. 11, Frank L. Wells, Lloyd E. Herdle and Alexander Walker, Jr., Nov. 1969.

* cited by examiner

*Primary Examiner* — Anthony Calandra
(74) *Attorney, Agent, or Firm* — Ryan P. O'Connor

(57) ABSTRACT

A method for the fractionation of lignocellulosic materials into cellulose, hemicelluloses and lignin in a batch or continuous process in a treatment with vaporous mixture of aliphatic alcohol, sulfur dioxide and water. Cooking conditions are varied to get different proportions of cellulose, hemicelluloses and lignin. Chemical recovery through pressure release is described.

15 Claims, 1 Drawing Sheet

A flow sheet example of the invention process.

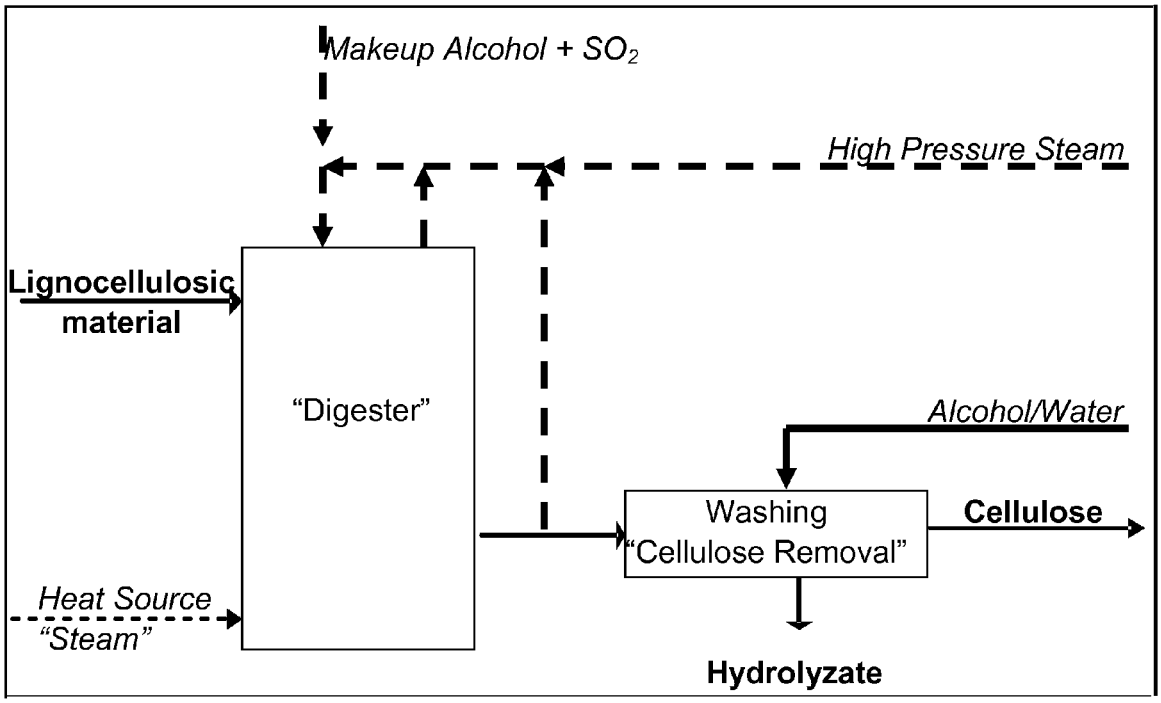
A flow sheet example of the invention process.

METHOD FOR VAPOR PHASE PULPING WITH ALCOHOL AND SULFUR DIOXIDE

CONTINUATION

This is a continuation of provisional patent application No. 61/064,744

DESCRIPTION

1. Field of the Invention

This invention relates, in general, to the fractionation of lignocellulosic material into lignin, cellulose and hemicelluloses, under vaporous cooking chemicals. In particular, alcohol sulfite vapors are applied to separate wood chips into cellulose fibers and dissolved lignin and hemicelluloses in an integrated biorefinery process.

2. Background of the Invention

Fractionation technologies of lignocellulosic material into its main subcomponents of cellulose, lignin and hemicelluloses have existed both in commercial practice and at the research level. Two examples are commercial sulfite pulping and the National Renewable Energy Laboratory, NREL, clean fractionation technology research.

Commercial sulfite pulping has been practiced since 1874. Industrial variants using calcium, magnesium, sodium and ammonia were developed by the 1940's.

Sulfite pulping produces spent cooking liquor termed sulfite liquor. Fermentation of sulfite liquor to hemicellulosic ethanol has been practiced primarily to reduce the environmental impact of the discharges from sulfite mills since 1909. In particular, a mill in Temiscaming, Ontario further ferments the sugars in ammonium sulfite spent liquor and sells the leftover lignosulfonates. Published design data from one of the two known remaining sulfite mills that produce ethanol, shows ethanol yields not to exceed 33% of the original hemicelluloses in wood. Ethanol yield is low due to the incomplete hydrolysis of the hemicelluloses and because only six carbon sugars are fermented, and further is further limited by the presence of sulfite pulping side products, such as furfural, methanol, acetic acid and others which inhibit fermentation to ethanol Because of poor ethanol yield, lower cost of synthetic ethanol production from oil feed stock, and the production of ethanol from corn today, only two sulfite mills are known to have continued the practice of hemicellulosic ethanol production to date.

In the mid $20^{th}$ century, Kraft pulping had eclipsed sulfite pulping as the dominant chemical pulping method. Kraft pulping however does not fractionate lignocellulosic material into its primary components. Instead, hemicelluloses are degraded in a strong solution of sodium hydroxide with or without sodium sulfide and lignin.

Vapor phase Kraft pulping is taught by Richter et al. (U.S. Pat. No. 3,532,594 Oct. 6, 1970). Inorganic cooking chemicals used for Kraft pulping must be impregnated in a separate vessel prior to vapor phase cooking. Additional cooking chemicals are then provided by fine spray to the cooking vessel to maintain appropriate chemical charge.

Solvent cooking chemicals have been tried as an alternative to Kraft or sulfite pulping. The original solvent process is described in U.S. Pat. No. 1,856,567 by Kleinert et al. Although three demonstration size facilities for ethanol-water (ALCELL), alkaline sulfite with anthraquinone and methanol (ASAM), and ethanol-water-sodium hydroxide (Organocell) were operated briefly in the 1990's, today there are no full scale solvent pulping mills. Of these technologies only ALCELL produced native reactive lignin by the use of pure aqueous organic solvents in elevated thermodynamic conditions. Lora, et al. (U.S. Pat. No. 5,865,948, Feb. 2, 1999) taught us that woodchips can be presteamed with a solvent present. The bulk delignification itself done in liquid phase under 6-9 parts of solvent liquid to one part of wood.

Gordy taught us pulping process to digest wood in vapors of sulfur dioxide and ammonia (U.S. Pat. No. 4,259,147, Mar. 31, 1981). Different grade pulps could be produced varying time from 10 to 60 minutes.

Groombridge et al. in U.S. Pat. No. 2,060,068 shows that an aqueous solvent with sulfur dioxide is a potent delignifying system to produce cellulose from lignocellulosic material. Their process was limited to 9% concentration of sulfur dioxide in the liquid phase.

Finally, in U.S. Pat. No. 5,730,837 to Black et al. claims liquid phase fractionation of lignocellulosic material into lignin, cellulose and dissolved sugars using ketone, alcohol, water and mineral acid. This is more readily known as the NREL clean fractionation technology. The separation of lignin and sugars in two immiscible layers are noted.

The present inventors have found pulping in aqueous alcohol solution with high concentration of sulfur dioxide leads to rapid solubilization of lignin and hemicelluloses. The concentration of sulfur dioxide is limited by solubility of sulfur dioxide at about 10% (w/w) in aqueous solution and 25% in ethanol solutions at room temperature. The solubility decreases rapidly at higher temperatures, making a commercial practice at very high concentration difficult.

Therefore in the prior art of digesting lignocellulosic material:

a) The sulfite processes take a long time to produce cellulose because of the low free sulfur dioxide charge and the slow diffusion of the counter cations.
b) The Kraft process requires pre immersion to facilitate cooking chemical penetration to wood chips using water as a solvent.
c) Organic solvent pulping methods used generally high solvent to wood ratios to facilitate delignification.
d) Gaseous ammonia—sulfur dioxide pulping is an effective pulping medium.
e) Alcohol sulfite liquid phase pulping is limited by the reverse solubility of sulfur dioxide in liquids at higher temperatures.

Surprisingly, the current inventors found the delignification rate to be approximately equal in vapor phase cooking. This discovery enables higher sulfur dioxide concentration applied on the wood chips, which speeds delignification and reduces cellulose degradation. Furthermore the cooking in vapor phase may improve the process economy by reducing the amount of cooking liquor charged to bulky wood chips and be suitable for dry and wet material.

The present inventors have now developed a process for the treatment of lignocellulosic material which produces pulp, fractionates the material and then converts each fraction into a reactive chemical feedstock. This is achieved through cooking lignocellulosic material with vapor phase with sulfur dioxide and ethanol. This can be done in a batch or continuous process.

BRIEF SUMMARY OF THE INVENTION

The present invention describes a process of fractionating lignocellulosic material into lignin, cellulose and hydrolyzed hemicelluloses through a vapor phase cooking with an aliphatic alcohol and sulfur dioxide. In the preferred embodiment of the invention, the wood chips are digested in pressurized vessel with low liquor volume, so that the cooking space is filled with ethanol and sulfur dioxide vapor in equilibrium with wood moisture. The cooked wood chips are washed in alcohol rich solution to recover lignin and dissolved hemicelluloses, while the remaining pulp is further processed to cellulose and paper products.

BRIEF DESCRIPTION OF THE DRAWINGS

A more complete understanding of the present invention may be obtained by reference to the following detailed description when read in conjunction with the accompanying drawings wherein:

FIG. 1. Illustrates a flow sheet example of the vapor phase pulping process, noting that the process steps may be in other sequences.

DETAILED DESCRIPTION OF THE INVENTION

A process for fractionating lignocellulosic material in to chemically reactive components through vapor phase cooking of lignocellulosic material with gases of aliphatic alcohol, water, and sulfur dioxide comprising the steps of:

Charging wood chips, with approximate dimensions of 1"×½"×⅛", in a pressurized vessel.

Filling the vessel partially with gaseous or aqueous solution of sulfur dioxide and ethanol separately or together.

Heating the vessel by direct steam injection or indirectly heating the cooling solution until most of the solution is in vapor phase of the digester.

Relieving the pressure in digester and recovering excess cooking chemicals for reuse.

Pumping or blowing the digested wood chips through a valve along with dilution to obtain a pulp suspension of certain consistency in a storage tank.

Washing to separate lignin and hemicelluloses from cellulose pulp in several stages.

The first process step is "cooking", element 1 in FIG. 2, which fractionates the lignocellulosic material components to allow easy downstream removal; specifically lignin and hemicelluloses are dissolved. Cellulose is separated but remains resistant to hydrolysis. Lignin is partially sulfonated rendering it alcohol and water soluble form. Lignocellulosic material is processed, "cooked", in a vapor phase of aliphatic alcohol, water, and sulfur dioxide where typical ratios by weight are 40-60% of both aliphatic alcohol and water, and 9-50% of sulfur dioxide, and preferably 40% aliphatic alcohol, 40% water and 20% sulfur dioxide; this solution is termed cooking liquor. Aliphatic alcohols can include ethanol, methanol, propanol and butanol, but preferably ethanol. The cooking may be performed in one or more stages using batch or continuous digesters. Depending on the lignocellulosic material to be processed, the cooking conditions are varied, with temperatures from 65° C. to 160° C., for example 65° C., 75° C., 85° C., 95° C., 105° C., 115° C., 125° C., 130° C. 135° C., 140° C. 145° C., 150° C., 155, 160° C. and corresponding pressures from 1 atmosphere to 20 atmospheres. The sulfur dioxide charge in the cooking liquor is varied between 9% and 50%, for example 9%, 10%, 11%, 12%, 13%, 14%, 15%, 16%, 17%, 18%, 19,%, 20% 25%, 30, 35%, 40, 45% and 50% of the total cooking liquor mass in one or more cooking stages. Cooking time of each stage is also varied between 1 minutes and 180 minutes, for example 1, 5, 10, 15, 30, 45, 60, 90, 120, 140, 160, 180 minutes. The lignocellulosic material to cooking liquor ratio can is varied between 1:1 to 1:4, for example, 1:1, 1:2, 1:3, or 1:4, and preferably 1:2.

Hydrolyzate from the cooking step is subjected to pressure reduction, either at the end of a cook in a batch digester, or in an external flash tank after extraction from a continuous digester. The flash vapor from the pressure reduction is collected and recompressed for reuse in the digester vessel. The flash vapor contains substantially all the unreacted sulfur dioxide. The cellulose is then removed to be washed and further treated as required.

The process washing step, element 2 in FIG. 1, recovers the hydrolyzate from the cellulose. Cellulose removed in the washing step can be diverted for papermaking or in a preferred embodiment can be bleached into paper furnish.

In an another embodiment of the invention, air dry or fresh wood chips are contacted with a solution of ethanol and water and SO2 in a digester, followed by drainage of the cooking liquor and then vapor phase cooking by direct injection of steam and/or ethanol vapor at a temperature and pressure to obtain the desired cooking temperature.

Although other modifications and changes may be suggested by those skilled in the art, it is the intention of the inventors to embody within the patent warranted hereon all changes and modifications as reasonably and properly come within the scope of their contribution to the art.

The invention claimed is:

1. A process for fractionating a lignocellulosic material, said process comprising:

(a) providing a liquid solution comprising an aliphatic alcohol, water, and sulfur dioxide, wherein said sulfur dioxide is present in a concentration of from 9 wt % to 25 wt % of said liquid solution;

(b) contacting a lignocellulosic material with a vapor phase of said liquid solution in a cooking stage, wherein said vapor phase comprises water vapor, alcohol vapor, and sulfur dioxide gas, and wherein a mass ratio of said liquid solution to said lignocellulosic material is from 1 to 3;

(c) delignifying said lignocellulosic material with said vapor phase in said cooking stage at a cooking temperature selected from 120° C. to 160° C. and a cooking time selected from 5 minutes to 3 hours, to produce a mixture comprising cellulose, hemicellulose oligomers, and lignin; and (d) removing cellulose from said mixture and washing said cellulose with a washing solution comprising a second amount of said aliphatic alcohol and a second amount of water, to produce a chemical pulp product and a liquid hydrolyzate stream comprising sugars and lignin.

2. The process of claim 1, wherein said sulfur dioxide is present in a concentration of from 12 wt % to 25 wt % of said liquid solution.

3. The process of claim 1, wherein said aliphatic alcohol is selected from the group consisting of methanol, ethanol, propanol, butanol, and any combinations thereof.

4. The process of claim 1, wherein said aliphatic alcohol is present in a concentration of from 40 wt % to 60 wt % of said liquid solution.

5. The process of claim 1, wherein said vapor phase contains an alcohol-water mass ratio of said alcohol vapor to said water vapor of from 0.5 to 5.

6. The process of claim 1, wherein said mass ratio of said liquid solution to said lignocellulosic material is from 1 to 2.

7. The process of claim 1, said process further comprising recovering residual aliphatic alcohol and sulfur dioxide and recycling said residual aliphatic alcohol and said sulfur dioxide to said cooking stage separately.

8. The process of claim 1, said process further comprising bleaching said chemical pulp product to produce paper furnish.

9. The process of claim 1, said process further comprising reducing said cooking pressure to release flash vapors, and then compressing and recycling said flash vapors to said cooking stage.

10. A process for fractionating a lignocellulosic material, said process comprising:

(a) contacting a lignocellulosic material with a liquid solution comprising an aliphatic alcohol, water, and sulfur dioxide in a cooking stage, wherein said sulfur dioxide is present in a concentration of from 9 wt % and 25 wt % in said liquid solution, and wherein a mass ratio of said liquid solution to said lignocellulosic material is from 1 to 3;

(b) draining said liquid solution from said cooking stage;

(c) injecting a vapor solution comprising steam and said aliphatic alcohol into said cooking stage to reach a cooking temperature selected from 120° C. to 160° C.;

(d) delignifying said lignocellulosic material in a vapor phase within said cooking stage at said cooking temperature and said cooking pressure, for a cooking time selected from 5 minutes to 3 hours, to produce a mixture comprising cellulose, hemicellulose oligomers, and lignin; and (e) removing cellulose from said mixture and washing said cellulose with a washing solution comprising a second amount of said aliphatic alcohol and a second amount of water, to produce a chemical pulp product and a liquid hydrolyzate stream comprising sugars and lignin.

11. The process of claim 10, wherein said liquid solution comprises sulfur dioxide in a concentration of from 12 wt % to 25 wt %.

12. The process of claim 10, wherein said aliphatic alcohol is selected from the group consisting of methanol, ethanol, propanol, butanol, and any combinations thereof.

13. The process of claim 10, wherein said aliphatic alcohol is present in a concentration of from 40 wt % to 60 wt % of said liquid solution.

14. The process of claim 10, wherein said vapor phase contains an alcohol-water mass ratio of said aliphatic alcohol to said steam of from 0.5 to 5.

15. The process of claim 10, wherein said mass ratio of said liquid solution to said lignocellulosic material is from 1 to 2.

* * * * *